United States Patent [19]

Shigeta et al.

[11] 4,147,598

[45] Apr. 3, 1979

[54] METHOD FOR PRODUCING COLORED ANODIC OXIDE FILMS ON ALUMINUM BASED ALLOY MATERIALS

[75] Inventors: Fumio Shigeta; Kazuyoshi Kaneda, both of Shizuoka, Japan

[73] Assignee: Riken Keikinzoku Kogyo Kabushiki Kaisha, Shizuoka, Japan

[21] Appl. No.: 835,833

[22] Filed: Sep. 22, 1977

Related U.S. Application Data

[63] Continuation of Ser. No. 670,247, Mar. 25, 1976, abandoned.

[30] Foreign Application Priority Data

Aug. 27, 1975 [JP] Japan ..... 50-103628
Jan. 28, 1976 [CN] China ..... 6510196

[51] Int. Cl.[2] ..... C25D 11/14; C25D 11/22; C25D 11/08

[52] U.S. Cl. ..... 204/35 N; 204/58; 204/DIG. 9

[58] Field of Search ..... 204/35 N, 58, DIG. 9

[56] References Cited

U.S. PATENT DOCUMENTS

| | | | |
|---|---|---|---|
| 3,704,210 | 11/1972 | Patrie | 204/35 N |
| 3,892,636 | 7/1975 | Kaneda et al. | 204/35 N |
| 3,915,813 | 10/1975 | Abe et al. | 204/35 N |
| 3,929,593 | 12/1975 | Sugiyama et al. | 204/35 N |
| 3,977,948 | 8/1976 | Martinez | 204/35 N |

*Primary Examiner*—F. C. Edmundson
*Attorney, Agent, or Firm*—Finnegan, Henderson, Farabow & Garrett

[57] ABSTRACT

Method for producing colored anodic oxide films on aluminum-based alloy materials comprising steps of subjecting the material having an oxide film thereon to a coloring electrolytic treatment in a bath of electrolyte containing water soluble nickel salt and boric acid. The material is applied with alternating voltage pulses having negative pulse duration which is the same as or greater than duration of positive voltage pulse.

5 Claims, No Drawings

METHOD FOR PRODUCING COLORED ANODIC OXIDE FILMS ON ALUMINUM BASED ALLOY MATERIALS

This is a continuation of application Ser. No. 670,247, filed Mar. 25, 1976, now abandoned.

The present invention relates to a method for producing coloured anodic oxide coatings on aluminum or aluminum-based alloy materials.

It has een known that coloured anodic oxide films can be produced on aluminum or aluminum alloys (hereinafter simply referred to as aluminum based metal) by firstly anodizing the aluminum based metals to produce anodically oxidized films thereon and then subjecting them to an electrolytic process wherein the anodized metals are dipped in a bath of electrolyte having metal salt dissolved therein in such a manner that the metals serve as one or both of the electrodes. As a result, the anodic oxide films on the metals are applied with colours which may be different in accordance with the types of the metal salts added into the bath.

For example, the U.S. Pat. No. 3,382,160 issued to T. Asada on May 7, 1968 teaches that anodic oxide films produced on aluminum based metals can be coloured by subjecting the anodized aluminum based metals to electrolytic process with alternating current in an acidic bath containing metal ions such as nickel, cobalt, chromium, copper or cadmium ions. Further, the U.S. Pat. No. 3,669,856 issued to O. C. Gedde on June 13, 1972 teaches that colours on anodized films can be easily controlled by subjecting anodized metals to asymmetric alternating voltage in an anodic bath containing metal ions.

In these electrolytic colouring processes, the anodic oxide films are coloured by the metal ions which are first drawn into pore structures in the anodic oxide films in the cycle of operation wherein the metal is subjected to a negative voltage and then educed when the metal is subjected to a positive voltage. It is known that the colours thus produced on the anodic oxide films will depend on the locations and amount of the metal ions educed in the pore structures of the films. However, the conventional processes cannot provide positive control of such locations and amount of the metal ions educed in the pore structures of the films but control is performed in such a manner that the bath temperature and the processing time are appropriately determined to obtain a desired amount of eduction of metal ions, so that it is very difficult to obtain products of uniform colour. Particularly, in the conventional processes, it has been experienced that even very small variations in the processing time have influences on colours produced in the films.

For exaple, referring to bronze based colours which include a bright amber colour as well as a dark blackish colour, it has been very difficult to obtain products of a desired and uniform colour through the conventional processes since colour changes have been experienced even in the same production lot due to very small unavoidable changes in the bath temperature and the processing time.

Therefore, the present invention has an object to provide a process for producing coloured anodic oxide films on aluminum based metals with minimum variations in colours.

Another object of the present invention is to provide a process for applying colours to anodic oxide films on aluminum based metals in a bath of electrolyte having a pre-selected composition.

A further object of the present invention is to provide a process for producing coloured anodic oxide films on aluminum based metals by applying alternating voltage pulses having negative pulse duration longer than positive pulse duration in a bath of electrolyte including water-soluble nickel salt and boric acid.

According to the present invention, the above and other objects can be accomplished by a method for producing coloured anodic oxide films on aluminum based metals comprising steps of producing anodic oxide films on the metals, immersing the metals in a bath of electrolyte including water-soluble nickel salt and boric acid, and applying to the metals alternating voltage pulses having negative pulse duration which is at least the same as positive pulse duration.

According to the method of the present invention, since the electrolyte contains boric acid, there is produced a complex of nickel salt and boric acid in the vicinity of the previously formed anodic films. Further, the aluminum based metal is subjected to high level energy at the rising and end periods of each pulse. Thus, the colouring agents or the metal ions rapidly fill the active level of the porous structures in the anodic oxide films, so that eductions of the colouring metal ions are terminated after a predetermined time to produce uniform and identical colours.

The present invention will further be described with reference to preferred examples.

Aluminum based material is at first subjected to a conventional anodizing treatment to produce an oxide film thereon. The anodized material is then dipped into a bath of electrolyte containing boric acid and water-soluble nickel salt in such a manner that it constitutes one of opposing electrodes. The other of the opposing electrodes may be constituted by another anodized material. The bath may include 10 to 50g of boric acid for each liter of water. Preferably, boric acid is added until the electrolyte is saturated thereby. The amount of water-soluble nickel salt may be 15 to 150 grams per liter of water. It is preferable in accordance with the present invention that nickel acetate, nickel sulfate or nickel chloride is used as the water soluble nickel salt, however, other nickel salts may be used if they are soluble in water.

The aluminum based material thus dipped in the electrolytic bath is then applied with alternating voltage pulses with negative pulse voltage and duration longer than positive pulse voltage and duration. The voltage thus applied to the material to be treated may comprise alternating positive and negative pulses or, alternatively, may comprise a plurality of positive pulses which are followed by a plurality of negative pulses. Pulsating voltages of any wave form may be applied provided that they can apply high level energies to the materials to be treated.

According to the present invention, the anodic oxide film on the material is given with bronze based colours which are inherent to nickel ions and which may be selected in the range including relatively bright amber through relatively dark blackish colour simply by determining the values of the alternating voltage pulses. It is possible in accordance with the present invention to provide uniform and substantially identical colours in the anodic oxide films provided that the treatment is performed beyond a certain required time. Thre will be no colour change in accordance with change in processing time and/or temperatute.

modificatons may be made without departing from the scope of the appended claims.

Table 1

| Processing Data | | | | | | | | |
|---|---|---|---|---|---|---|---|---|
| Negative Pulse | | Positive Pulse | | | | Colour Tone | | |
| Average Voltage (Volt) | Duration (sec) | Average Voltage (Volt) | Duraton (sec) | Processing Time | Colour | Y | X | Z |
| | | | | 3 | | 29.95 | 29.40 | 24.38 |
| | | | | 5 | | 22.65 | 22.25 | 17.90 |
| 13 | 3 | 13 | 1 | 7 | Amber | 14.20 | 14.35 | 10.35 |
| | | | | 10 | | 15.20 | 15.03 | 10.15 |
| | | | | 3 | | 29.00 | 28.23 | 22.20 |
| 13 | 3 | 10 | 3 | 5 | Rich Amber | 19.03 | 18.65 | 14.07 |
| | | | | 7 | | 15.85 | 15.65 | 11.52 |
| | | | | 10 | | 14.90 | 14.55 | 10.33 |
| | | | | 3 | | 15.12 | 14.88 | 10.53 |
| | | | | 5 | | 9.74 | 9.58 | 6.73 |
| 13 | 3 | 11 | 1 | 7 | Bronze | 5.11 | 4.72 | 3.75 |
| | | | | 10 | | 4.75 | 4.23 | 4.42 |
| | | | | 3 | | 14.82 | 14.76 | 10.53 |
| 15 | 3 | 13 | 1 | 5 | Rich Bronze | 7.75 | 7.35 | 6.10 |
| | | | | 7 | | 4.80 | 4.43 | 3.92 |
| | | | | 10 | | 4.56 | 3.96 | 4.48 |
| | | | | 3 | | 7.85 | 7.56 | 5.80 |
| 15 | 3 | 10 | 1 | 5 | Black | 5.45 | 5.03 | 4.90 |
| | | | | 7 | | 4.82 | 4.42 | 4.90 |
| | | | | 10 | | 4.32 | 3.63 | 4.65 |

EXAMPLE

An aluminum based alloy (1100) was at first subjected to a conventional anodizing process to form thereon an oxide film. Then, the material is dipped in a bath of colouring electrolyte contaning 50g of boric acid and 100 g of $Ni(CH_3COO)_2.4H_2O$ per one liter of water. Thereafter, colouring electrolytic process was performed by applying to the material for 3 to 10 minutes such voltage pulses that comprise alternating positive and negative pulses. The bath was maintained at a temperature of 20° to 20° C. The results are shown in Table 1 wherein the characters X, Y and Z designate Munsell notations.

From Table 1, it will be understood that an amber-like colour can be produced by applying to the material alternating voltage pulses comprising alternating negative voltage pulses of 13 volt and 3 second duration and positive voltage pulses of 13 volt and 1 second duration. If the treatment is performed for at least 7 minutes, the processing time does not have any effect on the colour.

The composition of the bath used in the preceding example was determined in accordance with the following experiment.

Aluminum based alloy members having anodic oxide films were dipped in a bath of electrolyte having a composition as shown in Table 2 and maintained at a temperature of 20 to 20° C. and then alternating voltage pulses were applied across the members for five minutes. The alternating voltage pulses comprised negative pulses of 12.5 volt of average voltage and duration of 3 seconds, and positive pulses of 5.5 volts of average voltage and duration of 1 second. The results are also shown in Table 2. The Munsell notations in Table 2 are average values of those obtained through several experiments. Since visual texts proved that variations in colour were the smallest with the bath containing 100 g/l of nickel salt and 50 g/l of boric acid, the electrolyte of the aforementioned composition was used.

The invention has thus been shown and described with reference to specific examples, however, it should be noted that the invention is in no way limited to the details of the described examples but changes and Table 2

| Electrolyte(g/l) | | Colour Tone | | |
|---|---|---|---|---|
| Ni Salt | Boric Acid | Y | X | Z |
| | 20 | 4.4 | 3.7 | 4.4 |
| 10 | 35 | 3.5 | 2.8 | 3.8 |
| | 50 | 3.3 | 2.9 | 3.6 |
| | 20 | 3.0 | 2.3 | 3.6 |
| 20 | 35 | 2.7 | 2.2 | 3.3 |
| | 50 | 2.5 | 2.0 | 3.0 |
| | 20 | 2.7 | 2.1 | 3.4 |
| 30 | 35 | 2.6 | 2.1 | 3.3 |
| | 50 | 2.2 | 1.7 | 2.8 |
| | 20 | 2.5 | 2.0 | 3.4 |
| 40 | 35 | 2.7 | 2.1 | 3.5 |
| | 50 | 2.2 | 1.7 | 3.0 |
| | 20 | 2.7 | 2.1 | 3.5 |
| 70 | 35 | 2.5 | 1.9 | 3.2 |
| | 50 | 2.2 | 1.7 | 2.9 |
| | 20 | 2.8 | 2.3 | 3.5 |
| 100 | 35 | 2.2 | 1.8 | 2.8 |
| | 50 | 2.2 | 1.7 | 2.9 |

We claim:

1. A method for producing coloured oxide films comprising subjecting an aluminum based material to an anodizing treatment to produce an oxide film thereon, dipping the material in an electrolyte bath containing from about 70 to about 150 grams of water-soluble nickel salt per liter of water and from about 20 to about 50 grams of boric acid per liter of water, wherein the bath is maintained at a temperature between about 20° and about 22° C., and applying alternating voltage pulses to the aluminum based material, the alternating voltage pulses including more than one negative voltage pulse and more than one positive voltage pulse, and wherein the negative voltage puses have a duration which is at least the same as that of the positive voltage pulses, the negative voltage pulses have a range of from about 12.5 to about 15 volts, and the positive voltage pulses have a range of from about 5.5 to about 13 volts.

2. The method in accordance with claim 1 wherein the water-soluble nickel salt is selected from the group consisting of nickel acetate, nickel sulfate and nickel chloride.

3. The method in accordance with claim 2 wherein the water-soluble nickel salt is nickel sulfate.

4. The method in accordance with claim 1 wherein the bath contains from about 100 to about 150 grams of nickel salt per liter of water.

5. The method in accordance with claim 1 wherein the positive voltage pulses are applied in durations of from about 1 to about 3 seconds.

* * * * *